US009944371B2

(12) United States Patent
Hawkes

(10) Patent No.: US 9,944,371 B2
(45) Date of Patent: Apr. 17, 2018

(54) POSITIVELY BUOYANT, VERTICAL THRUST, MANNED SUBMERSIBLE

(71) Applicant: Hawkes Ocean Technologies, Point Richmond, CA (US)

(72) Inventor: Graham Hawkes, Pt. Richmond, CA (US)

(73) Assignee: DEEPFLIGHT, Point Richmond, CA (US)

( * ) Notice: Subject to any disclaimer, the term of this patent is extended or adjusted under 35 U.S.C. 154(b) by 0 days.

(21) Appl. No.: 15/379,289

(22) Filed: Dec. 14, 2016

(65) Prior Publication Data

US 2017/0297667 A1 Oct. 19, 2017

Related U.S. Application Data

(63) Continuation of application No. 14/341,346, filed on Jul. 25, 2014, now Pat. No. 9,522,718.

(51) Int. Cl.
*B63G 8/16* (2006.01)

(52) U.S. Cl.
CPC ..... *B63G 8/16* (2013.01)

(58) Field of Classification Search
CPC ... B63G 8/08; B63G 8/14; B63G 8/00; B63G 8/16; B63C 11/42; B63H 5/14
USPC ..... 114/331
See application file for complete search history.

(56) References Cited

U.S. PATENT DOCUMENTS

| | | | | |
|---|---|---|---|---|
| 5,704,309 | A * | 1/1998 | Kohnen | B63G 8/22 114/123 |
| 9,522,718 | B2 * | 12/2016 | Hawkes | B63G 8/16 |
| 2017/0297667 | A1 * | 10/2017 | Hawkes | B63G 8/16 |

* cited by examiner

*Primary Examiner* — Lars A Olson
*Assistant Examiner* — Jovon Hayes
(74) *Attorney, Agent, or Firm* — Staniford Tomita LLP

(57) ABSTRACT

The present invention is directed towards a fixed positively buoyant manned submersible that includes a plurality of vertical thrusters and a sealed enclosure(s) that can support one or more human passengers. The vertical thrusters can include vertically aligned propellers that are coupled to motors that control the rotational velocity of the propellers. The vertical thrusters to generate a negative vertical thrust to allow the submersible to dive within a body of water. Horizontal movement can be achieved through horizontal thrusters or directing the thrust vectoring of the vertical thrusters.

19 Claims, 10 Drawing Sheets

POSITIVELY BUOYANT, VERTICAL THRUST, MANNED SUBMERSIBLE

CROSS REFERENCE TO RELATED APPLICATION

This application is a continuation of U.S. patent application Ser. No. 14/341,346, "Positively Buoyant, Vertical Thrust, Manned Submersible" filed Jul. 25, 2014, which is now U.S. Pat. No. 9,522,718.

BACKGROUND

Manned submersibles traditionally use variable buoyancy, either by changing weight or changing volume for diving. Descent is achieved or aided by negative buoyancy and ascent is achieved or aided by positive buoyancy.

SUMMARY OF THE INVENTION

The present invention is directed towards a fixed positively buoyant manned submersible that includes a plurality of vertical thrusters and a sealed enclosure(s) that can support one or more human passengers. The vertical thrusters can include vertically aligned propellers that are coupled to motors that control the rotational velocity of the propellers. In an embodiment, a submersible can have one or more forward vertical thrusters on a forward portion and one or more rear vertical thrusters on a rear portion. The vertical thrusters can each generate a negative vertical thrust to allow the submersible to dive within a body of water. By controlling and changing the thrust outputs of the vertical thrusters, the submersible can move in translation as well as pitch, roll and yaw rotations.

Horizontal movement can be achieved through horizontal thrusters or directing the thrust vectoring of the vertical thrusters. In an embodiment, thrust vectoring can be performed by rotating the entire submersible. By rotating the submersible in pitch to raise the nose portion, the vertical thrusters are rotated back so that a horizontal component of the thrust moves the submersible forward. Conversely, rotating the submersible in the opposite pitch with the nose down will direct the horizontal component of the vertical thruster forward, slowing or reversing the forward movement of the submersible. In another embodiment, thrust vectoring can be performed by using thrust directing mechanisms that are mounted adjacent to the vertical thrusters. For example, a plurality of vanes can be used to control the direction of the thrust output. In yet another embodiment, the vertical thrusters can be mounted on a rotation mechanism such as a gimbal, and actuators can control the rotational positions of the vertical thrusters. Thrust vectoring can be performed by rotating the vertical thrusters relative to the hull of the submersible. By controlling the direction and outputs of the vertical thrusters, the submersible can hover or move in rotation and/or translation.

The operation of the submersible can preferably be controlled by a pilot passenger. The pilot controls can include: pitch, roll, yaw and thrust controls. In an embodiment, a control system can be used to assist in controlling the submersible and monitoring the movement and position of the submersible. The control system can include a processor that receives control signals from the pilot as well as signals from various sensors and controls the thrust and directional outputs of the thrusters to perform the desired submersible movement. The sensors can include: velocity sensors, XYZ axes accelerometers and gyroscopes.

DETAILED DESCRIPTION

The present invention is directed towards a manned submersible that is always positively buoyant with vertical thrust propulsion mechanisms. It is inherently safer if the submersible craft remains positively buoyant at all times. Currently, minimum safe positive buoyancy is at least 3-5% of displacement. Thus, a submersible that has a total displacement of 2,000 kgs. can have a positive buoyance of at least about 2,060-2,100 kgs. In order to overcome the positive (upward) vertical buoyancy forces, a negative (downward) vertical force produced that is greater than minimum positive buoyancy is required to dive below the water surface. This negative vertical force can be substantially different than the common variable buoyancy method, which must have a negative buoyancy to descend deeper into the water.

One method for providing negative vertical force is by using a fixed positively buoyant submersible craft. The negative lift of the wings is greater than the positive buoyancy of the submersible, which allows the craft to dive underwater. A winged submersible is described in U.S. Pat. No. 7,131,389 for "Winged Submersible" which is hereby incorporated by reference in its entirety. The winged submersible can be an analogue to fixed wing flight where flight is possible because the upward force from the lift of the wings is greater than the gravitational force on the airplane.

Figure 1:
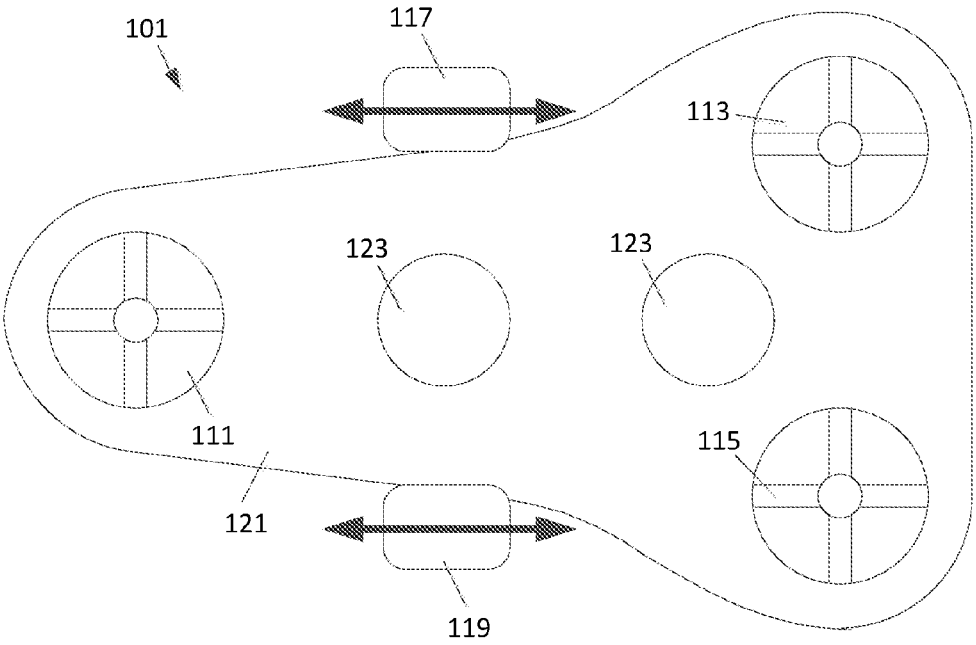
FIG. 1 illustrates a top view of an embodiment of a submersible with vertical and horizontal thrusters.
Figure 2:
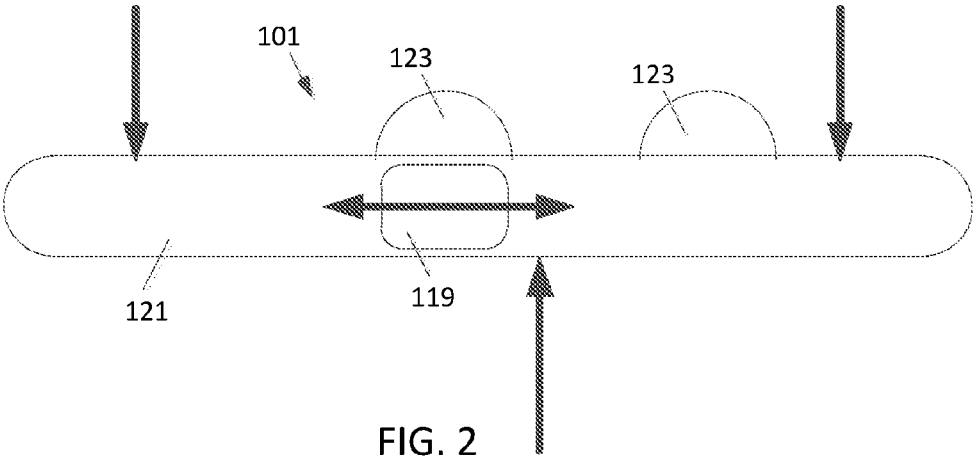
FIG. 2 illustrates a side view of an embodiment of a submersible with vertical and horizontal thrusters.

With reference to FIGS. 1 and 2, an embodiment of a positively buoyant, vertical thrust, manned submersible 101 is illustrated. FIG. 1 illustrates a top view and FIG. 2 illustrates a side view. The hull 121 of the submersible 101 has a sealed enclosure(s) 123 that can fit one or more human passengers. The sealed enclosure(s) can provide sufficient oxygen for the duration of the submersible use. In an embodiment, the submersible 101 can provide 2 redundant 12 hour supplies of oxygen. The submersible 101 can have one or more clear windows 123 that allow the passengers to see out of the submersible 101 and view their surroundings. In an embodiment, heads of the passengers maybe positioned within clear hollow hemispherical shaped domes that are part of the sealed enclosure(s) 123.

In the illustrated submersible designs, two person pressure hull cockpits 123 are provided for the crew. However, in other embodiments, the submersible 101 can include one or more common cockpits 123 that can support any number of passengers or crew. The hull 121 of the submersible can be made from a high strength carbon reinforced composite with metal deck plates and lifting inserts.

FIG. 1 illustrates a single front vertical thruster 111 and two rear vertical thrusters 113, 115 as well as two horizontal thrusters 117, 119. However, in other embodiments, any number of vertical thrusters can be used with the submersible 101. Although the hull 121 has a rounded corner triangular shape, in other embodiments, the hull can have any other geometric shape.

The vertical thrusters 111, 113, 115 are typically electrically powered large diameter ducted propellers that have an optimized propulsive coefficient for downward thrust. The propulsive coefficient Pc is the coefficient of actual useful work output from a thruster divided by the actual work output from the thruster. The thrust times the vehicle velocity is Vv and the actual work output is T times the jet (exit) velocity is Vt. The propulsive efficiency Pc is represented by the equation, $Pc=Vv/Vt$. Thus, any thruster working with the vehicle stationary $Vv=0$ has a propulsive coefficient that is 0%. If the thruster exhaust jet velocity is the same as the vehicle velocity the propulsive coefficient is 100%.

The thrust can be roughly proportional to mass flow rate, times jet (Vt) velocity and the mass flow rate is proportional to the cross sectional area of the thruster, the density of the medium, and square of (Vt) jet velocity. So the thrust can be proportional to a thruster cross section diameter squared (Area) times Vt squared. However, for the same thrust a bigger the thruster cross section diameter requires less power to achieve the same static (V=0) thrust. For example, for a first thruster can have a first diameter and a second thruster can have a diameter that is twice the diameter of the first thruster and four times the cross section area of the first thruster. For same thrust jet velocity only halve the power will be needed by the second thruster compared to the first thruster to produce the same thrust output. For improved efficiency, the largest practical thruster diameter can be used with the submersible.

The thrust T can be separated into vertical and horizontal components. The thrust T needed by a submersible vehicle is equal to or greater than the drag D to move through the water. Because the submersible must overcome the buoyancy to remain in a static underwater position, the vertical component of the submersible's thrust T needs to consume energy just to maintain a fixed depth, just as a helicopter works hard just to hold a fixed altitude. So although the vertical propulsive efficiency can be zero, the efficiency is based upon the amount of energy (electrical power) needed to achieve a vertical thrust that is equal to the positive buoyancy.

The propellers in the thrusters can be highly efficient for lower speed recreational submersible applications, which may not exceed speeds of 10 knots or depths greater than 100 meters. In an embodiment, the propellers my have a diameter between about 0.5-1.0 meter with a rotational velocity of 200-350 rotations per minute (RPM).

In order to overcome the buoyant forces, the vertical thrusters must be able to provide more vertical thrust. In an embodiment, the total negative vertical force generated by the thrusters can be at least 50% greater than the positive buoyant force of the fully loaded submersible. In order to maintain precise control of the thrust outputs of the vertical thrusters 111, 113, 115, the rotational velocity of the propellers must be controllable. In an embodiment, the electric motors used in the vertical thrusters 111, 113, 115, can be sensor positioned brushless motors that can provide controllable and stable rotational velocity control.

In a preferred embodiment, this invention uses multiple vertical thrusters 111, 113, 115 grouped with a forward vertical thruster 111 in front of the center of buoyancy and the right rear vertical thrusters 113 and the left rear vertical thruster 115 can be behind the center of buoyancy. The forward vertical thruster 111 can be positioned on a centerline of the submersible 101, the right rear vertical thruster 113 can be on a right side of the centerline and the left rear vertical thruster 115 can be on a left side of the centerline. The outer ends of the propeller blades can be positioned within the hull 121 housing and the moving parts of the horizontal thrusters can be within housings so that physical contact with the sides of the submersible will not result in contact with the rotating propellers. The thrusters can be powered by rechargeable lithium ion batteries housed within a dry water proof portion of the hull 121 of the submersible. In a preferred embodiment, the lithium batteries have a high energy storage capacity, high power output and a fast re-charge.

The inventive submersible 101 is a positively buoyant manned vehicle that can safely dive down by generating downwards, controlled negative vertical thrust that is sufficient to overcome its positive vertical buoyancy forces. The control over downward thrust enables controlled descent, hover and ascent. When the submersible 101 is placed in the water, the submerged vertical thrusters 111, 113, 115 can be actuated to generate a downward thrust. In order to maintain a desired pitch orientation, the forces generated by the vertical thrusters 111, 113, 115 can be balanced about the center of buoyancy of the submersible 101. In this embodiment, the single front vertical thruster 111 can provide more negative vertical thrust force that either of the two rear vertical thrusters 113, 115. The submersible 101 can be propelled forward, backwards or in yaw rotation by controlling the thrust outputs of the horizontal thrusters 117, 119.

The pitch of the submersible 101 can be altered by changing the output forces produced by the vertical thrusters 111, 113, 115. The thrusters 111, 113, 115 can have fixed pitch propeller blades so that the thrust output force is proportional to the rotational rate of the propeller with a faster rotation producing a higher thrust output. Thus, to decrease the pitch of the submersible and lower the front portion of the submersible 101, the vertical thrust of the front vertical thruster 111 can be increased and/or the outputs of the rear thrusters 113, 115 can be decreased. Conversely, to increase the pitch of the submersible and raise the front portion, the front thruster 111 output can be decreased and/or the rear thrusters 113, 115 can be increased.

The submersible can also rotate in roll by changing the relative thrusts of the two rear thrusters 113, 115. Increasing the right rear thruster 113 and/or decreasing the left rear thruster 115 can cause the submersible 101 to roll to the right. Conversely, increasing the left rear thruster 115 and/or decreasing the right rear thruster 113 can cause the submersible 101 to roll to the right. Changing the roll can be allow the passengers to view specific areas and help to turn the submersible 101.

The yaw of the submersible 101 can be controlled by the horizontal thrusters 117, 119. Right yaw rotation can be achieved by increasing the left horizontal thruster 119 and/or decreasing or reversing the right horizontal thruster 117. Left yaw rotation can be performed by increasing the right horizontal thruster 117 and/or decreasing or reversing the left horizontal thruster 119. By controlling the multiple vertical 111, 113, 118 and horizontal thrusters 117, 119, an operator can control the underwater movement of the submersible 101 to allow for movement and rotation in any desired direction.

Figure 3:
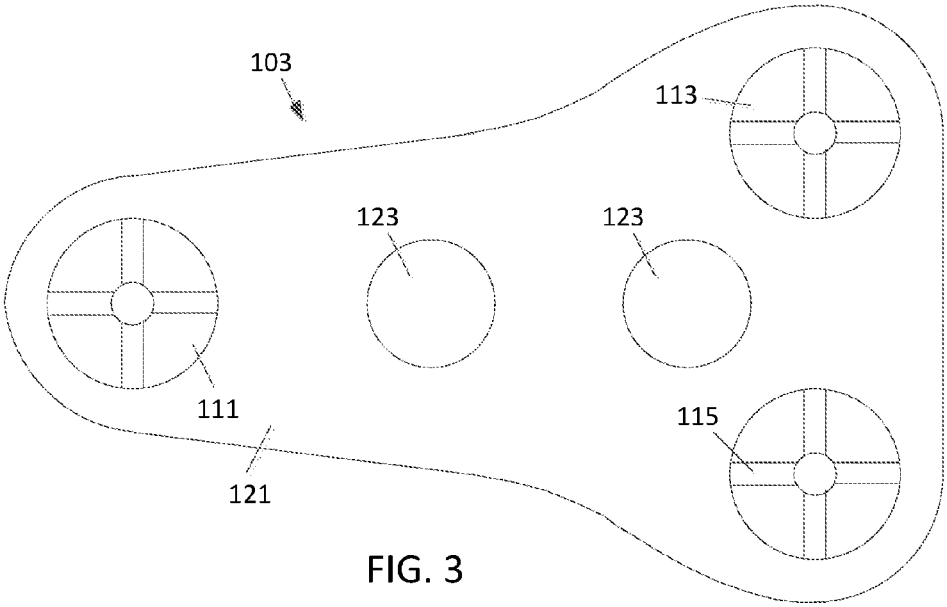
FIG. 3 illustrates a top view of an embodiment of a submersible with vertical thrusters.
Figure 4:
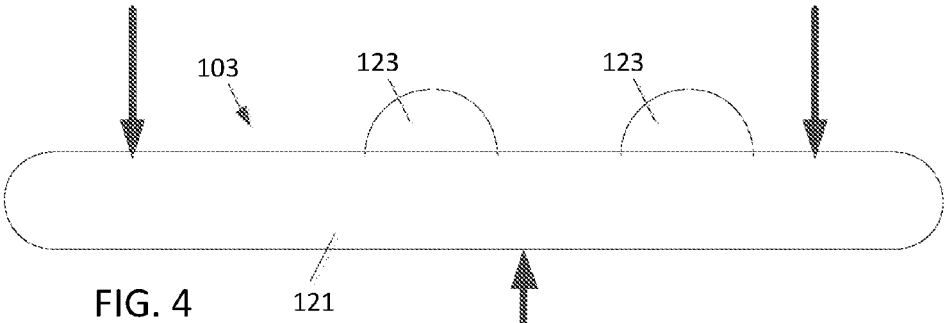
FIG. 4 illustrates a side view of an embodiment of a submersible with vertical thrusters.
Figure 5:
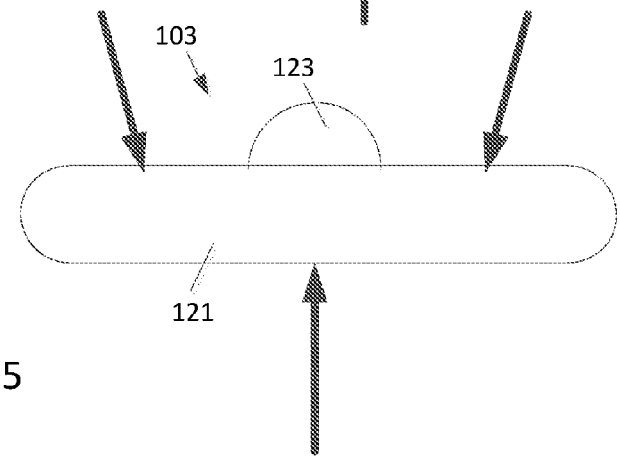
FIG. 5 illustrates a rear view of an embodiment of a submersible with vertical thrusters.

In other embodiments, the submersible may have vertical thrusters but no horizontal thrusters. FIG. 3 illustrates a top view and FIG. 4 illustrates a side view of an embodiment of a submersible 103 without horizontal thrusters. In this embodiment, the submersible 103 may hover or move in a pure vertical movement when the submersible 103 is horizontal. In order to achieve horizontal movement in forward and in reverse directions, the downward thrust can be apportioned between the thrusters 111, 113, 115 to rotate the submersible 103 in pitch. The pitch rotation of the craft can cause the vertical thrusters 111, 113, 115 to generate some horizontal thrust, which can cause the submersible 103 to move forwards and backwards. FIG. 5 illustrates a rear view of the submersible 103. In an embodiment, the right rear vertical thruster 113 and left rear vertical thruster 115 can be angled outwards which results in angled thrust forces.

Figure 6:
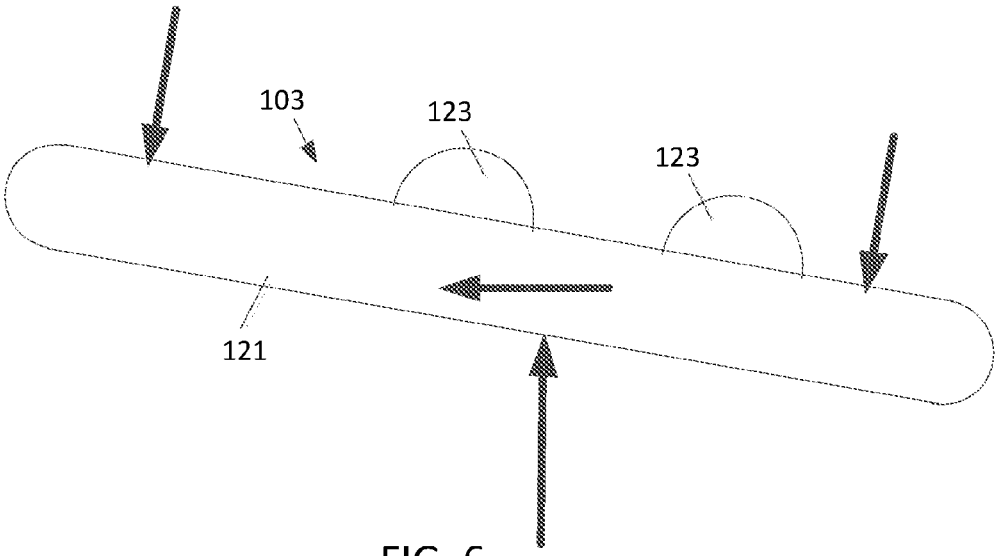
FIG. 6 illustrates a side view of an embodiment of a submersible with vertical thrusters moving forward.
Figure 7:
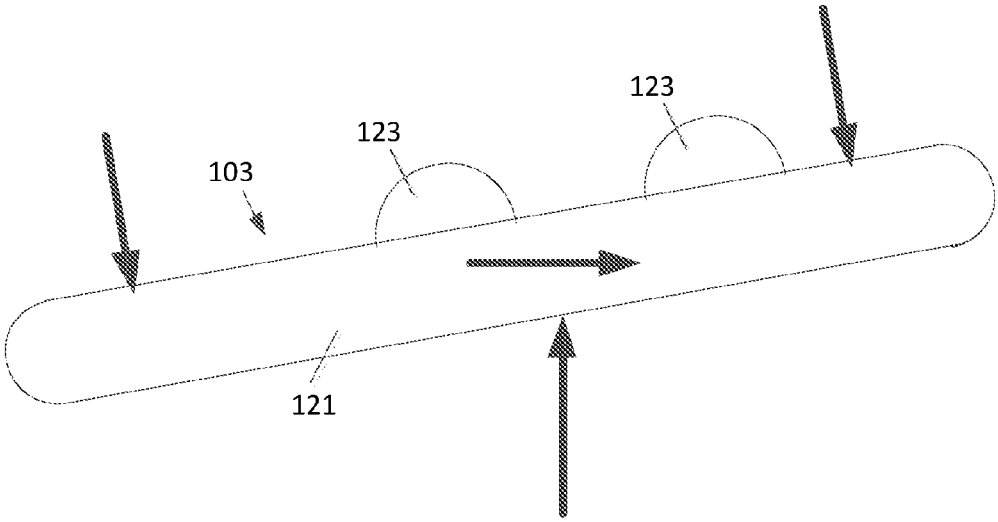
FIG. 7 illustrates a side view of an embodiment of a submersible with vertical thrusters moving backwards.

With reference to FIG. 6, to move forward the submersible 103 may rotate in pitch to move the front up which causes the vertical thrusters 111, 113, 115 to produce both vertical and horizontal thrust. By tilting the nose further upwards, a forward component of the vertical thrust increases and the submersible 103 can move forward at a faster velocity. The buoyant vertical force will remain in a vertical direction and will not oppose the horizontal thrust. For example, if the submersible was rotated nose up in pitch 15 degrees and the cumulative thrust output was 100 kgs., the vertical force would be 96 kgs. and the horizontal force would be 26 kgs., which can cause the submersible to move with a horizontal velocity of about 2 knots. With reference to FIG. 7, tilting the nose down will rotate the submersible 103 forward resulting in the thrust being directed forwards which results in a reverse horizontal force applied on the submersible 103 by the thrusters 111, 113, 115.

Figure 8:
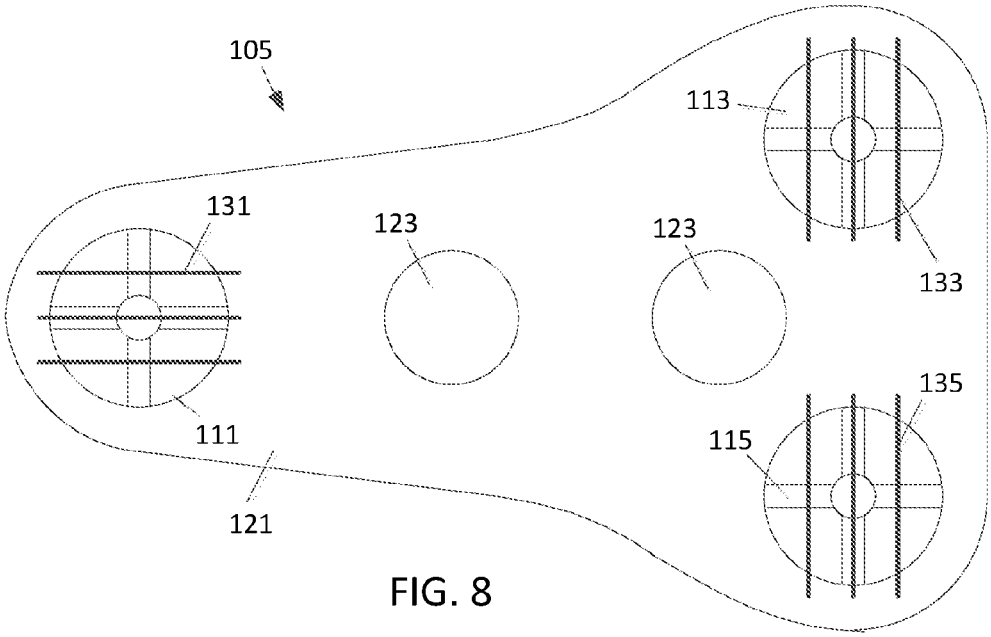
FIG. 8 illustrates a top view of an embodiment of a submersible with vertical thrusters and direction control vanes.
Figure 9:
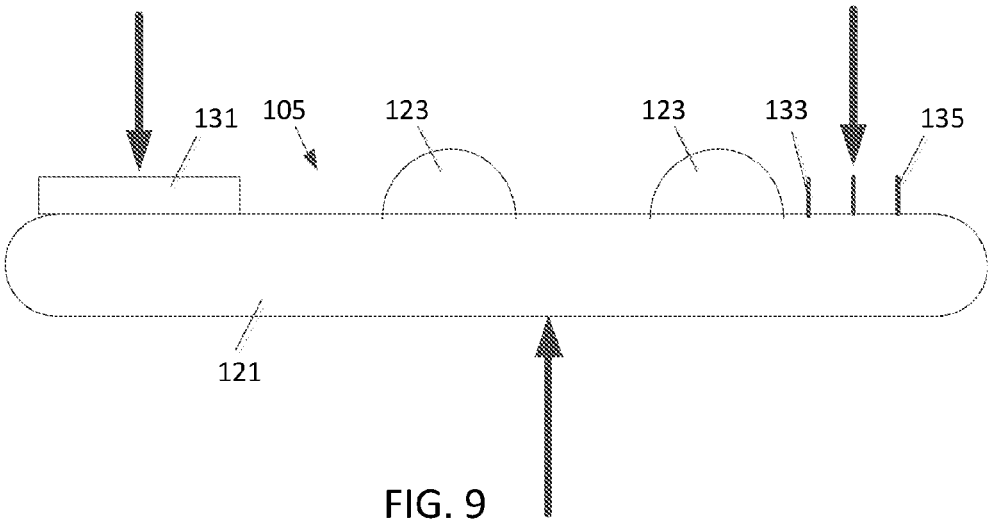
FIG. 9 illustrates a side view of an embodiment of a submersible with vertical thrusters and direction control vanes.

In other embodiments, the direction of the vertical thruster outputs can be controlled. For example with reference to FIG. 8, a top view of a submersible 105 with a plurality of vanes 131, 133, 135 can be used to change the direction of the vertical thrusters 111, 113, 115 is illustrated. The vanes 131, 133, 135 can be planar structures that adjacent to the propellers of the vertical thrusters 111, 113, 115. With reference to FIG. 9, a side view of the submersible 105 is illustrated. When the vanes 131, 133, 135 are vertically aligned they do not alter the direction of the water flowing from the propellers or the direction of the forces generated by the vertical thrusters 111, 113, 115. However, changing the angles of the vanes 131, 133, 135 can alter the direction of the water flow from the propellers, which can generate a horizontal force on the submersible 105. In the illustrated embodiment the vanes 131 over the front vertical thruster 111 are aligned with the centerline length of the submersible and the vanes 133, 135 over the rear vertical thrusters 113, 115 are aligned with the width of the submersible 105 perpendicular to the centerline. The directional control of the thrust of the vertical thrusters 111, 113, 115 is known as thrust vectoring.

The plurality of vanes 131, 133, 135 can be coupled to hinges that connect the vanes 131, 133, 135 to the hull 121 and allow the vanes 131, 133, 135 to rotate relative to the hull 121. Each set of vanes 131, 133, 135 can also be configured to rotate about the hinges in unison so that each group of vanes 131, 133, 135 are always parallel to each other. The pilot can control the guide vanes 131, 133, 135 either by "fly by wire" system that utilizes remotely controlled actuators for moving the vanes. The actuators can be hydraulic or electrically operated. Alternatively, the vanes 131, 133, 135 can be controlled by a direct linkage mechanism that can include cables that are coupled to a pilot operated control lever(s) such as a joy stick, throttle, rudder and/or other mechanical controllers.

The submersible 105 may rotate in pitch about the center of buoyancy force, which is represented by the upward arrow under the submersible 105. The downward forces generated by the vertical thrusters may need to be balanced about the center of buoyancy to maintain a desired orientation and avoid pitch rotation. If the total buoyant force of the submersible 105 is 100 kilograms, then the total negative force of the vertical thrusters should also be about 100 kilograms and the torque forces about the center of buoyancy should be balanced. For example, if the distance from the front vertical thruster 111 to the center of buoyancy is 3 meters then the torque forces of the front thruster is front thruster force×3 meters. If the distance from the rear vertical thrusters 113, 115 to the center of buoyancy is 2 meters, then the torque of the rear thrusters is rear thruster forces×2 meters.

The torque equation can be:

$$(\text{front thruster force})\times 3 \text{ meters} = 2\times(\text{rear thruster force})\times 2 \text{ meters}.$$

The vertical force equation can be:

$$\text{Buoyant force} = (\text{front thruster force}) + 2\times(\text{rear thruster force})$$

Solving these torque and vertical force equations results in:

$$\text{front thrust} = 40 \text{ kg and rear thrust} = 30 \text{ kg for each of the rear thrusters.}$$

Figure 10:
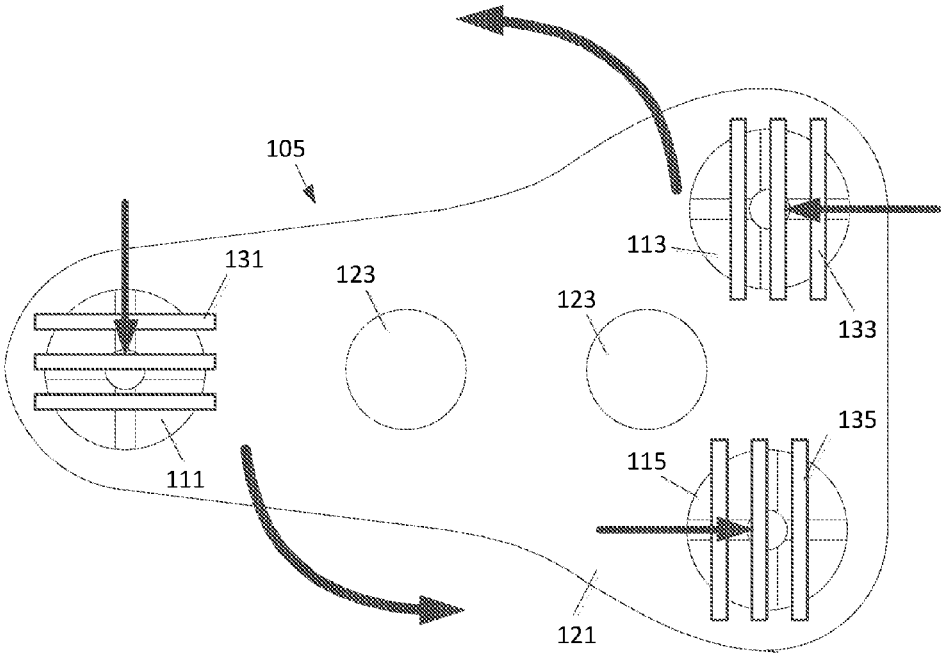
FIGS. 10 and 11 illustrate top views of an embodiment of a submersible with vertical thrusters and direction control vanes moving in yaw rotation.
Figure 11:
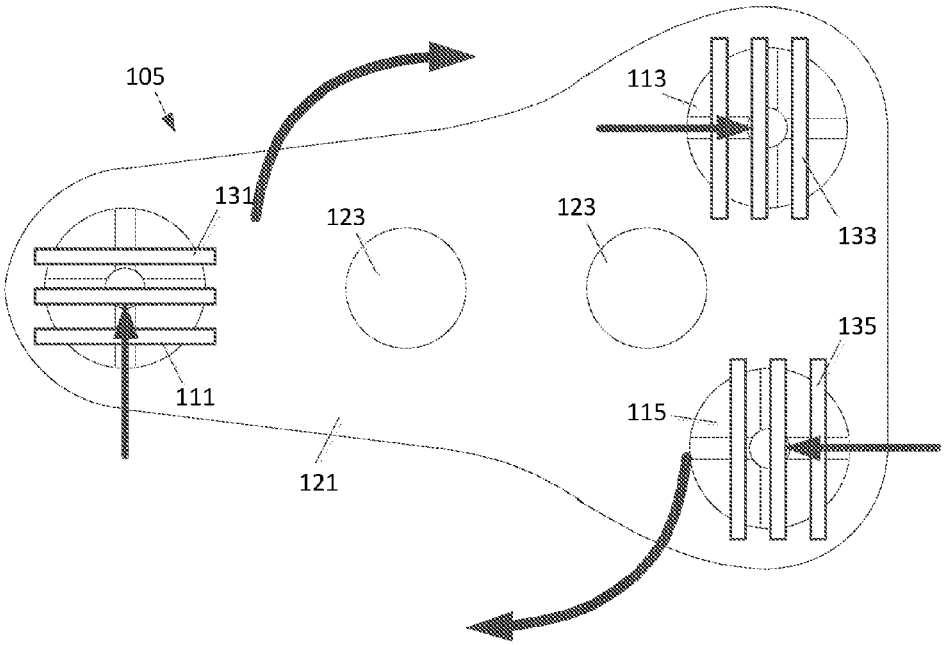

The position of the vanes 131, 133, 135 can be independently controlled so that each vertical thruster 111, 113, 115 can each provide a horizontal force on the submersible 105 which can be used to move the submersible 105 in translation or rotation. For example, the horizontal force components of each vertical thrusters 111, 113, 115 can independently or in combination operate to cause the submersible 105 to rotate in yaw. With reference to FIG. 10, the vanes 131 over the front vertical thruster 111 can be angled towards the right side of the submersible 105, the right rear vanes 133 can be angled back and the left rear vanes 135 can be angled forward. This combination of all vanes 131, 133, 135 working together or any individual vane can cause the submersible 105 to rotate in a counter clockwise rotation. FIG. 11 illustrates the vanes 131, 133, 135 positioned to rotate the submersible 105 clockwise in a yaw rotation with the front vanes 111 angled to the left side, the right rear vanes 133 angled forward and the left rear vanes 135 angled back.

Figure 12:
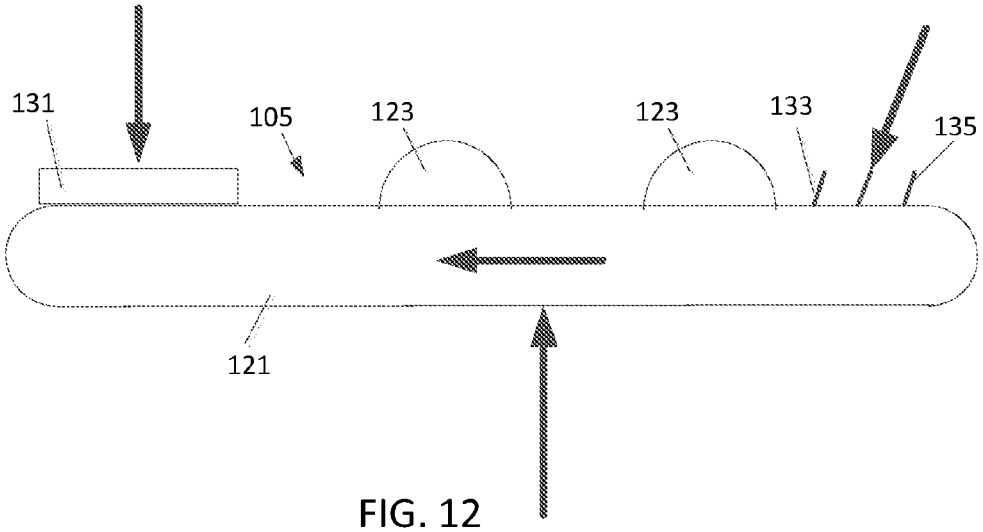
FIG. 12 illustrates a side view of an embodiment of a submersible with vertical thrusters and direction control vanes moving forward.

In other embodiments, the vanes 131, 133, 135 may have specific horizontal movement functions. For example, in an embodiment, the front vertical thruster 111 can provide rotational yaw control while the rear vertical thrusters 113, 115 can provide forward and reverse forces. In this configuration, the horizontal direction of the submersible 105 can be controlled by moving the front vanes 131. Moving the vanes 131 of the front vertical thruster 111 towards the right side of the submersible 105 will cause the submersible 105 to turn left and moving the vanes 131 toward the left side will cause the submersible 105 to turn right. With reference to FIG. 12, the movement of the rear thruster vanes 133, 135 back will cause the submersible 105 to move forward.

As discussed, the pitch of the submersible 105 can also be controlled and the vane system can allow the submersible 105 to be stationary in any rotational position. For example with reference to FIG. 13, with the nose down the front thruster 113 is no longer vertically oriented and generates a horizontal force that will tend to move the submersible 105 backwards. However, the vanes 133, 135 of the rear thrusters 113, 115 can be angled backwards so that they generate a forward horizontal force that is balanced with the rear force of the front vertical thruster 111. Again, the buoyant force of the submersible 105 is always vertical and the vertical forces of the front thruster 113 and rear thrusters 115, 117 can be balanced about the center of buoyancy to prevent pitch rotation as described above.

Figure 14:
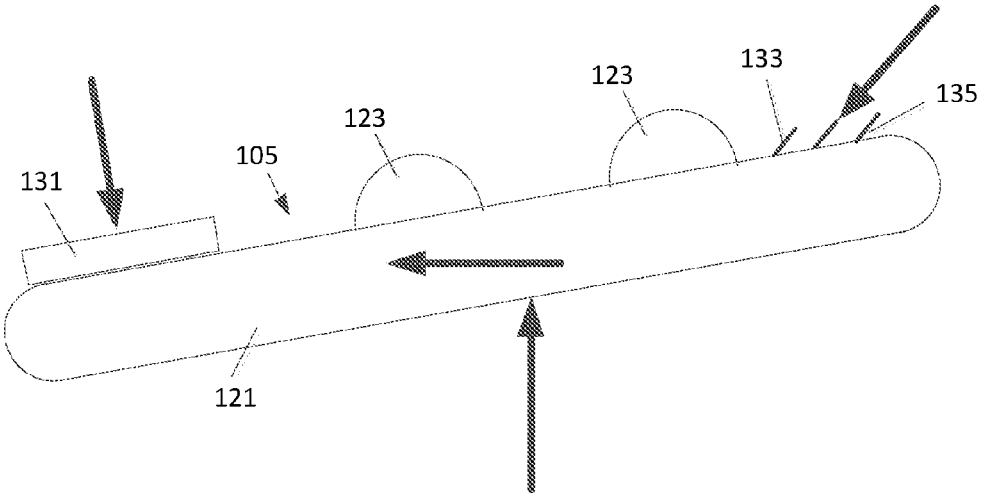
FIG. 14 illustrates a side view of an embodiment of a submersible with vertical thrusters and direction control vanes moving forward in a pitch forward orientation.
Figure 15:
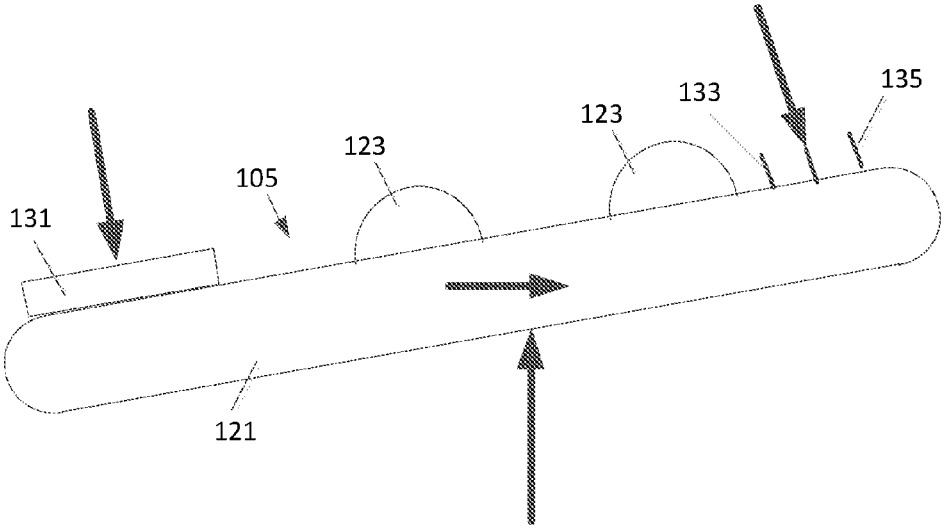
FIG. 15 illustrates a side view of an embodiment of a submersible with vertical thrusters and direction control vanes moving backwards in a pitch forward orientation.

In addition to allowing an operator to maintain a stationary position in any rotational orientation, the inventive system can also be used to provide movement in any rotation position. With reference to FIG. 14, the vanes 133, 135 of the rear thrusters 113, 115 have been rotated further back so that the forward force on the submersible 105 is greater than the backward force from the front thruster 111. This force imbalance causes the submersible 105 to move forward. With reference to FIG. 15, the rear vanes 133, 135 have been rotated forward so both the front thrusters 111 and rear thrusters 113, 115 are generating backward forces, which cause the submersible 105 to move backwards.

Figure 16:
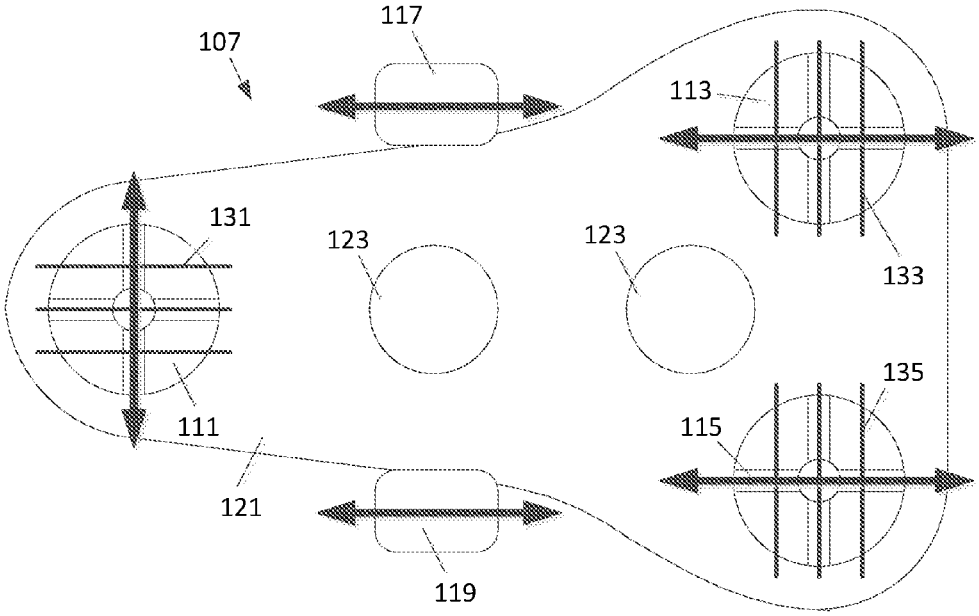
FIG. 16 illustrates a top view of an embodiment of a submersible with vertical thrusters, direction control vanes and horizontal thrusters.
Figure 17:
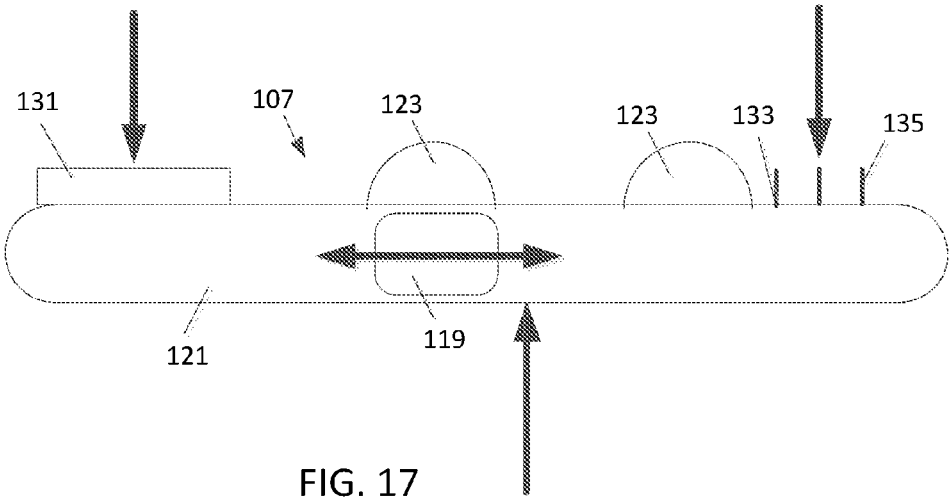
FIG. 17 illustrates a side view of an embodiment of a submersible with vertical thrusters, direction control vanes and horizontal thrusters.

In another embodiment with reference to FIGS. 16 and 17, the submersible 107 can have horizontal thrusters 117, 119 in addition to controllable vanes 131, 133, 135 adjacent to the vertical thrusters 111, 113, 115. The arrows illustrate the horizontal force outputs that are available to the illustrated submersible 107 configuration. Apportioning thrust between the side horizontal thrusters 117, 119 on a side of the hull 121 or angling the vanes 131, 133, 135 of the vertical thrusters 111, 113, 115 to generate a horizontal force component of vertical thrust can turn the submersible 107 in yaw as directed by the pilot. Such an asymmetrical horizontal component of vertical thrust can be generated by fixed deflection or angled thrust.

Note that although the vertical thrusters are illustrated in a vertical orientation, in other embodiments all or some of the vertical thrusters may be angled away from a pure vertical orientation to provide optimum thrust vectoring for normal operation. For example, the submersible may normally be operated with movement in a forward direction. Thus, the vertical thrusters can have exit thrust deflector vanes that normally create forwards thrust and the vanes can be angled relative to the thrusters to keep the submersible stationary or provide reverse horizontal forces. In another embodiment, the right rear and left rear vertical thrusters can be angled outwards which can provide improved directional control since there is less interference with the thrust outputs.

Figure 18:
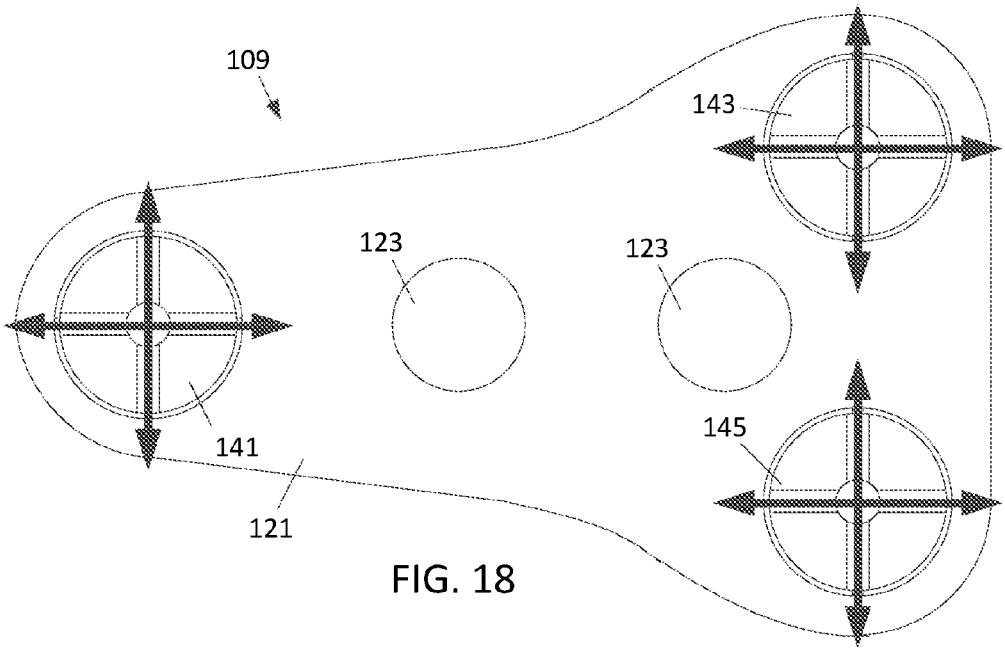
FIG. 18 illustrates a top view of an embodiment of a submersible with thrust vectoring vertical thrusters.

In other embodiments, other mechanisms can be used to change the thrust output of the vertical thrusters. For example, with reference to FIG. 18, the vertical thrusters 141, 143, 145 can be mounted on gimbal mechanisms or a rotating axes that allows the thrust to be directed at an angle away from vertical alignment. Because the entire thrusters 141, 143, 145 can be rotated, vanes or any other thrust deflection devices are not required. By rotating the vertical thrusters 141, 143, 145, the direction of the vertical thrusters power output can be controlled.

In an embodiment the front thruster can rotate about an axis parallel with the centerline so the front thruster 141 can be directed to the left or right side of the submersible 109. The rear thrusters 143, 145 can rotate about an axis perpendicular with the centerline and can be directed to the forward or back. In this configuration, the submersible 109 can be controlled in substantially the same manner described above with reference to the vane control embodiments illustrated in FIGS. 8-17.

Figure 13:
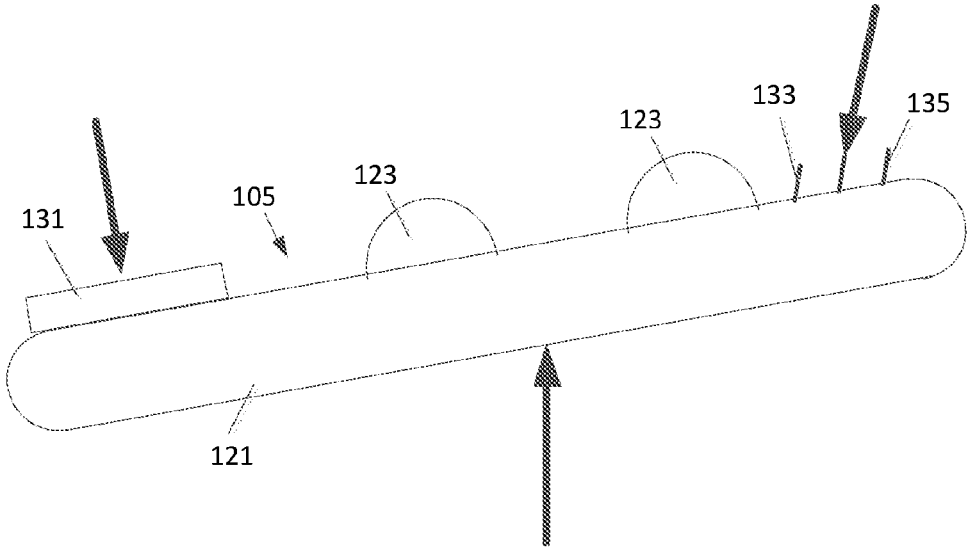
FIG. 13 illustrates a side view of an embodiment of a submersible with vertical thrusters and direction control vanes stationary in a pitch forward orientation.

Alternatively, the vertical thrusters 141, 143, 145 can be mounted on gimbal mechanisms that allow rotation about two axis which allows movement in the left, right, front and back directions. In this configuration, the vertical thrusters 141, 143, 145 can be directed to provide horizontal forces in any desired direction. Thus, the vertical thrusters 141, 143, 145 can operate in a coordinated manner that can be more efficient because the horizontal thrust components of the vertical thrusters 141, 143, 145 may never need to oppose each other (as shown in FIGS. 12 and 13).

Figure 19:
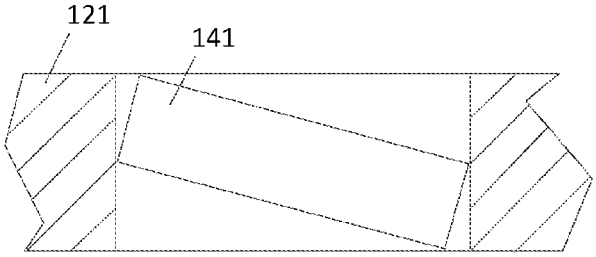
FIGS. 19 and 20 illustrate cross sectional views of a gimbaled vertical thruster.
Figure 20:
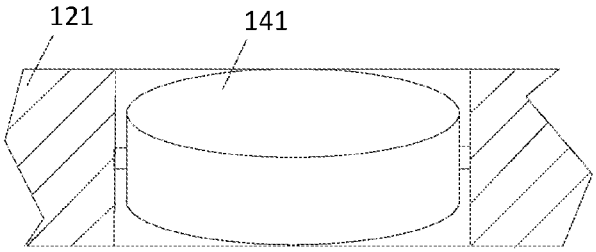

FIGS. 19 and 20 illustrate cross sectional views of a vertical thruster 141 mounted within a portion of the submersible hull 121. FIG. 19 illustrates the vertical thruster 141 rotated towards the rear and FIG. 20 illustrates the vertical thruster 141 rotated towards the left side. The gimbal mechanism may allow a limited range of movement so that the vertical thruster 141 remain within the upper and lower surfaces of the hull 121. In general, the vertical forces required by the submersible to balance with the buoyant forces will remain constant while the horizontal forces can vary depending upon the desired horizontal velocity. In an embodiment, the horizontal thrust can be less than about 50% of the vertical thrust. Thus, the rotational range of the thrusters can be limited to about 26 degrees of rotation, which will result in a thrust having a horizontal force component that is about 50% of the vertical force component.

Figure 21:
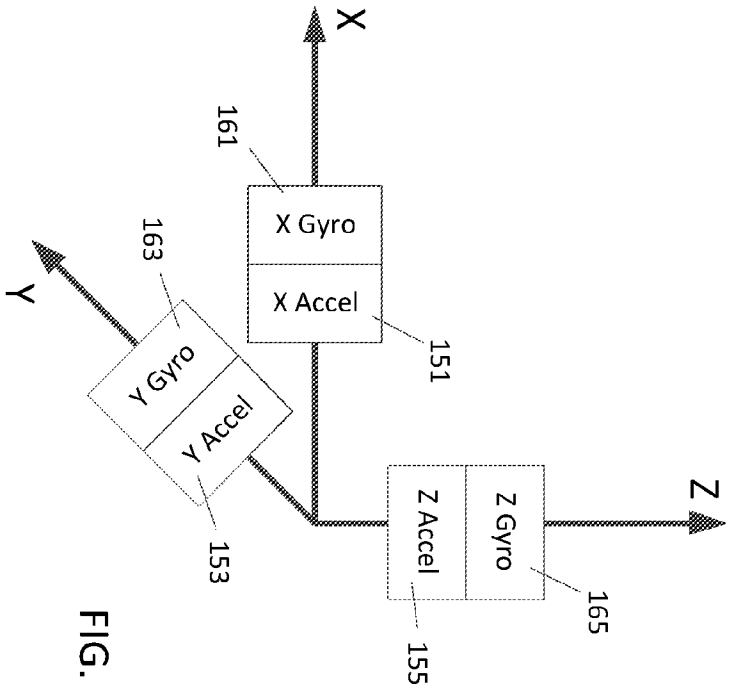
FIG. 21 illustrates accelerometers and gyroscopes configured in an X, Y and Z axes.

As illustrated and discussed above, the submersible can have many different and complex movement components. It can be very difficult for a pilot to simultaneously control all of these components manually. In order to simplify the pilot control, the submersible can include an automated control system that may include a processor coupled to one or more sensors. With reference to FIG. 21, the control system sensors can include one or more of: an X axis accelerometer 151, a Y axis accelerometer 153 and a Z axis accelerometer 155 and an X axis gyroscope 161, a Y axis gyroscope 163 and a Z axis gyroscope 165. The X axis defining the orientation of the sensors can be aligned with the centerline of the submersible, the Y axis can be horizontal and perpendicular to the X axis and the Z axis can be vertical and perpendicular to the X and Y axes. The accelerometers 151, 153, 155 can measure the gravitational force, which will always be straight down as well as acceleration and deceleration of the submersible. Thus, at a stopped or constant straight velocity movement, the accelerometer signals can indicate the rotational orientation of the submersible in pitch and roll. The gyroscopes 161, 163, 165 can measure the rotation of the submersible about the X, Y and Z axes. In other embodiments, the control system can include other sensors such as depth, pressure, temperature, velocity, etc.

Figure 22:
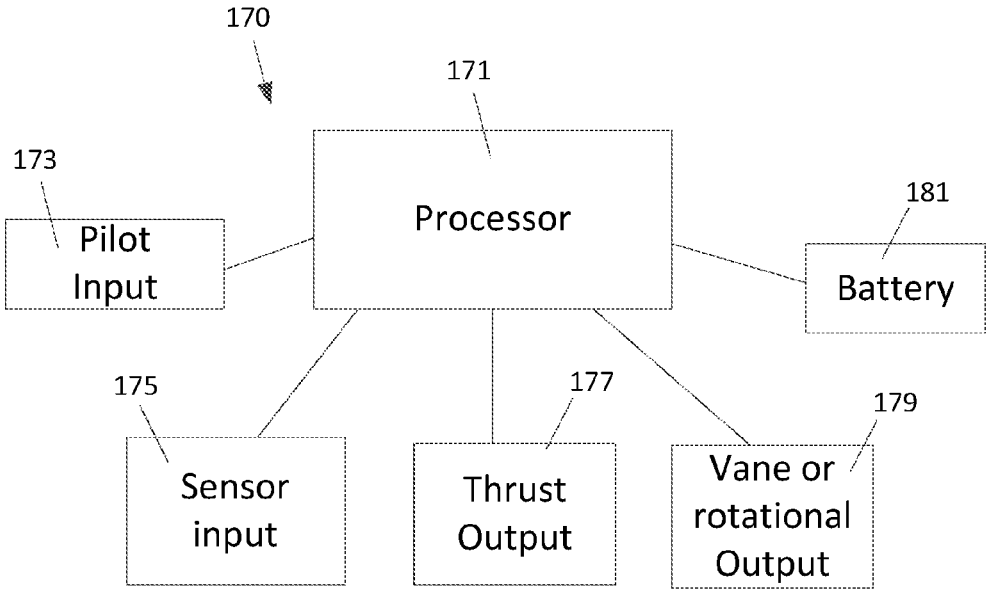
FIG. 22 illustrates a block diagram of an automated submersible control system.

With reference to FIG. 22, a block diagram of an embodiment of an automated submersible control system 170 is illustrated. The control system 170 can have a processor 171 that is coupled to pilot control inputs 173 and sensor inputs 175. The pilot control signals can include: joystick control for pitch and roll inputs, throttle control for forward, neutral or reverse thrust, rudder control for yaw inputs. In other embodiments, any other pilot input controls can be input to the processor 171. The sensor inputs 175 can include acceleration and gyroscope signals as discussed above as well as velocity and any other sensor signals.

Based upon the pilot input control signals and the sensor signals, the processor 171 can determine the desired submersible action and control the individual thrusters output power 177 and thrust direction 179. The processor 171, pilot controls 173, sensors 175, thrusters 177 and thruster directional controls 179 can be electric devices that are powered by a battery(ies) 181. The control system 170 can provide many submersible control functions. For example, the control system 170 can be instructed to maintain a specific pitch orientation. The submersible pilot can then input velocity and direction signals. The processor 171 can maintain the specified submersible pitch/roll and simultaneously control the thrusters output 177 and direction 179 to match the pilot velocity and direction controls. The control system 170 can continuously monitor the sensors 175 and make thrust and direction adjustment to maintain a set or intended pitch and roll rotation orientation. The automated control system 170 can be useful in situations where water currents or turbulence would normally disrupt and alter the rotational orientation of the submersible.

Thrust vectoring control can be obtained through deflection or rotation of the vertical thrusters in the pitch and roll directions. This controlled thrust deflection creates desired forces and moment forces enabling complete directional control of the submersible path without the implementation of the conventional hydrodynamic controls. The pilot can control depth (descend and ascend) by controlling the total vertical thrust. The pilot can thrust forwards or backwards by deflecting the thrusts in one embodiment or by controlling the thrust proportioned between forward and rear thrusters with pre-set thrust deflection or angled thrusters in other embodiments.

While the invention has been described herein with reference to certain preferred embodiments, these embodiments have been presented by way of example only, and not to limit the scope of the invention. Accordingly, the scope of the invention should be defined only in accordance with the claims that follow.

What is claimed is:

1. A submersible comprising:

a hull having at least one pressure pod for accommodating at least one person a right vertical thruster on the hull;

a left vertical thruster on the hull;

a first accelerometer for detecting a rotational orientation of the hull in pitch and a second accelerometer for detecting the rotational orientation of the hull in roll;

a control input for the at least one person; and a controller coupled to the right vertical thruster and the left vertical thruster for controlling thrust outputs of the vertical thruster based upon control signals from the control input and sensor signals from the first accelerometer and the second accelerometer;

wherein the submersible has a fixed positive buoyancy and does not include a variable buoyancy mechanism.

2. The submersible of claim 1 further comprising:

a roll controller for changing a roll of the submersible;

wherein the roll controller increases the thrust output of the right vertical thruster and/or decreases the thrust output of the left vertical thruster to roll the submersible to the left and the roll controller increases the thrust output of the left vertical thruster and/or decreases the thrust output of the right vertical thruster to roll the submersible to the right.

3. The submersible of claim 1 further comprising:

a right horizontal thruster on the hull; and a left horizontal thruster on the hull.

4. The submersible of claim 1 further comprising:

a yaw controller for changing a yaw of the submersible;

wherein the yaw controller increases the thrust output of a right horizontal thruster and/or decreases the thrust output of the left horizontal thruster to turn the submersible to the left and the yaw controller increases the thrust output of a left horizontal thruster and/or decreases the thrust output of the right horizontal thruster to turn the submersible to the right.

5. The submersible of claim 1 further comprising:

a forward vertical thruster on a forward portion of the submersible; and a pitch controller for changing a pitch of the submersible;

wherein the right vertical thruster is on rear portion of the hull, the left vertical thruster is on the rear portion of the hull and the pitch controller increases the thrust output of the forward vertical thruster and/or decreasing the thrust output of the right vertical thruster and the left vertical thruster to cause the submersible to pitch nose down and the pitch controller increases the thrust output of the right vertical thruster and the left vertical thruster and/or decreasing the thrust output of the forward vertical thruster to cause the submersible to pitch nose up.

6. The submersible of claim 1 wherein the hull does not include a rudder, wings or elevators.

7. The submersible of claim 1 wherein the hull does not include any hydrodynamic control surfaces.

8. A submersible comprising:

a hull having at least one pressure pod for accommodating at least one person a right vertical thruster on the hull;

a right vertical deflection vane adjacent to the right vertical thruster;

a left vertical thruster on the hull;

a left vertical deflection vanes adjacent to the left vertical thruster;

a first accelerometer for detecting a rotational orientation of the hull in pitch and a second accelerometer for detecting the rotational orientation of the hull in roll;

a control input for the at least one person; and a controller coupled to the right vertical deflection vane and the left vertical deflection vane for controlling thrust directions of the right vertical thruster and the left vertical thruster based upon control signals from the control input and sensor signals from the sensor;

wherein the submersible has a fixed positive buoyancy and does not include a variable buoyancy mechanism.

9. The submersible of claim 8 further comprising:

a roll controller for changing a roll of the submersible;

wherein the roll controller increases the thrust output of the right vertical thruster and/or decreases the thrust output of the left vertical thruster to roll the submersible to the left and the roll controller increases the thrust output of the left vertical thruster and/or decreases the thrust output of the right vertical thruster to roll the submersible to the right.

10. The submersible of claim 8 further comprising:

a forward vertical thruster on a front portion of the hull; and a forward deflection vane adjacent to the forward vertical thruster.

11. The submersible of claim 8 further comprising:

a right horizontal thruster on the hull; and a left horizontal thruster on the hull.

12. The submersible of claim 8 wherein the hull does not include a rudder, wings or elevators.

13. The submersible of claim 8 wherein the hull does not include any hydrodynamic control surfaces.

14. A submersible comprising:

a hull having at least one pressure pod for accommodating at least two people;

a right vertical thruster on the hull;

a left vertical thruster on the hull;

a forward vertical thruster on the hull;

a right horizontal thruster on the hull;

a left horizontal thruster on the hull;

a first accelerometer for detecting a rotational orientation of the hull in pitch and a second accelerometer for detecting the rotational orientation of the hull in roll;

a control input for the at least one person; and a controller coupled to the right vertical thruster and the left vertical thruster for controlling thrust outputs of the vertical thruster based upon control signals from the control input and sensor signals from the sensor;

wherein the submersible has a fixed positive buoyancy and does not include a variable buoyancy mechanism.

15. The submersible of claim 14 further comprising:

a horizontal velocity controller that alters the right horizontal thruster and the left horizontal thruster to change a horizontal velocity of the submersible.

16. The submersible of claim 14 further comprising:

a yaw controller coupled to the first actuator wherein the yaw controller alters outputs of the right horizontal thruster and the left horizontal thruster to change a yaw of the submersible.

17. The submersible of claim 14 further comprising:

a roll controller that increases the thrust output of the right vertical thruster and/or decreases the thrust output of the left vertical thruster to roll the submersible to the left and the roll controller increases the thrust output of the left vertical thruster and/or decreases the thrust output of the right vertical thruster to roll the submersible to the right.

18. The submersible of claim 14 further comprising:

a pitch controller that increases the thrust output of the first vertical thruster and/or decreasing the thrust output of the second vertical thruster to cause the submersible to pitch nose down and the pitch controller increases the thrust output of the second vertical thruster and/or decreasing the thrust output of the first vertical thruster to cause the submersible to pitch nose up.

19. The submersible of claim 14 wherein the hull does not include any hydrodynamic control surfaces.

* * * * *